US005144895A

United States Patent [19]

Murray

[11] Patent Number: 5,144,895

[45] Date of Patent: Sep. 8, 1992

[54] HOPPER DOOR APPARATUS FOR A RAILWAY CAR

[75] Inventor: John R. Murray, Findlay, Ohio

[73] Assignee: Differential Steel Car Company, Findlay, Ohio

[21] Appl. No.: 606,422

[22] Filed: Oct. 31, 1990

[51] Int. Cl.[5] ..... B61D 7/24

[52] U.S. Cl. ..... 105/286; 105/240; 105/245; 105/251

[58] Field of Search ..... 105/240, 241.2, 244, 105/245, 250, 251, 255, 282.3, 283, 286, 299

[56] References Cited

U.S. PATENT DOCUMENTS

| | | | |
|---|---|---|---|
| 2,600,357 | 6/1952 | Zimmerman | 105/292 |
| 2,729,503 | 1/1956 | Armington | 105/283 |
| 3,122,106 | 2/1964 | Novelli | 105/249 |
| 3,173,381 | 3/1965 | Charles et al. | 105/240 |
| 3,596,608 | 8/1971 | Aquino et al. | 105/251 |
| 3,596,609 | 8/1971 | Ortner et al. | 105/250 |
| 3,786,764 | 1/1974 | Beers, Jr. et al. | 105/240 |
| 3,902,434 | 9/1975 | Barnard et al. | 105/240 |
| 4,114,785 | 9/1978 | Dugge | 105/283 |
| 4,138,948 | 2/1979 | Korolls | 105/251 |
| 4,222,333 | 9/1980 | Schuller | 105/250 |
| 4,250,814 | 2/1981 | Stark et al. | 105/240 |
| 4,262,601 | 4/1981 | Miller | 105/241.2 |
| 4,452,149 | 6/1984 | LeMarbe | 105/250 |
| 4,740,130 | 4/1988 | Prins | 105/241.2 |

*Primary Examiner*—Joseph F. Peters, Jr.
*Assistant Examiner*—Virna L. Mojica
*Attorney, Agent, or Firm*—Marshall & Melhorn

[57] ABSTRACT

A door apparatus for a railway hopper car for discharging bulk material from the car has an elongated flexible hollow body positioned in a discharge opening. A pair of end walls are attached to opposite ends of the body. Each end wall has a first pivot point for rotary attachment to the body. The body is rotatable about the first pivot point between an opened position and a closed position. The body has an arcuate surface extending generally vertically when in the closed position to reduce the effort required to open the doors when the car is loaded. If the door apparatus is stuck in the closed position, such as when ice has formed between the longitudinal edge of the door apparatus and the edge of the discharge opening, a torque applied to one end of the door apparatus about the first pivot point tends to twist the door apparatus about the longitudinal axis.

11 Claims, 4 Drawing Sheets

HOPPER DOOR APPARATUS FOR A RAILWAY CAR

BACKGROUND OF THE INVENTION

The present invention relates generally to railway hopper cars and in particular, to door apparatuses for discharging material from bottom discharge hoppers.

A number of different types of railroad cars exist for hauling various types of bulk cargo and for discharging that cargo. For example, railway hopper cars carry coal, sand, aggregates and other loose materials which materials can be discharged through openings in hoppers located beneath such cars.

Generally, the hopper cars have a plurality of hoppers which store the cargo in readiness for discharge. A variety of door apparatuses are utilized to open and close material discharge openings formed in the bottoms of the hoppers.

U.S Pat. Nos. 2,600,357 and 3,122,106 disclose a pair of longitudinally disposed discharge doors having a rectangular cross-section in which the width is relatively small compared to the length The discharge doors, pivoted about a generally horizontal axis, open and close an open bottom of a railway car. The doors are held closed by a latching mechanism and when the latch is released, the doors pivot downwardly and inwardly to allow the material to exit the car.

Also related to the door apparatuses shown in the aforementioned patents are the U.S. Pat. Nos. 3,596,608; 4,138,948 and 4,114,785 which disclose a pair of longitudinally disposed discharge doors having a rectangular cross section. The doors pivot downwardly and outwardly to allow material to exit a railway car. The doors have a flange which either outwardly extends at a lower end as in U.S. Pat. No. 3,596,608, or outwardly extends at an upper end as in U.S. Pat. No. 4,114,785, or upwardly extends at an upper end as in U.S. Pat. No. 4,138,948.

U.S. Pat. Nos. 3,173,381 and 2,729,503 disclose a pair of longitudinally disposed discharge doors for a railway hopper car having a "clam-shell" shaped cross-section.

U.S. Pat. No. 3,786,764 discloses a pair of longitudinally extending discharge doors for a commodity discharge car, having a rectangular cross-section with extending lip portions on both ends of an upper and lower surface. The doors abut one another in a closed position approaching the horizontal. When pivoted open, the doors are rotated to a generally vertical position.

U.S. Pat. Nos. 3,902,434 and 4,740,130 disclose longitudinally extending discharge doors for a railway hopper car. The doors have an inverted trapezoidal cross-section area with inclined portions on the upper surface near an outer edge. The doors abut one another in a closed position approaching the horizontal. When pivoted open, the doors are rotated to a generally vertical position.

U.S. Pat. No. 4,262,601 discloses longitudinally extending inner and outer discharge doors. Each outer discharge door includes a longitudinal plate appropriately secured to a longitudinal extending channel at an inner edge and including a longitudinally extending rigidifying flange portion at an outer edge. Each inner discharge door includes a longitudinal plate appropriately secured to a pair of transversely spaced longitudinally extending channels. Each door includes a pair of longitudinally spaced stiffeners.

U.S. Pat. No. 4,452,149 discloses a pair of longitudinally extending bottom discharge doors having an arcuate door face plate held between door and walls having a triangular configuration. Each discharge door is further defined by a top and bottom wall having a centrally located partial cut out. Spaced gussets are attached intermittently to the door face plates and the top and bottom walls to provide stiffness.

SUMMARY OF THE INVENTION

The present invention concerns a door apparatus for railway hopper cars for discharging bulk material from the car. An elongated hollow door is positioned in a discharge opening and is rotatably attached to a hopper of a railway car at a first pivot point. The body of the door has an inverted bell-shape in cross section. A pair of end walls are attached to opposite ends of the body. Each end wall has a first pivot point for rotary attachment to the body. The body is rotatable about the first pivot point between an opened position and a closed position.

The walls of the body are thin to allow flexability for transmitting torque. The application of torque for rotating the car body about the first pivot point at one of the end walls is transmitted along the body to the other one of the end walls. The flexibility of the door is particularly advantageous when certain bulk materials such as grain are stored in the hopper. Such materials contain moisture which can cause ice to form upon the door. If the door is stuck in the closed position, because ice has formed between the longitudinal edge of the door and the edge of the discharge opening, a torque applied to one end of the door about the first pivot point tends to twist the door about the longitudinal axis. As the door body is twisted, the ice, formed on the door breaks up, thereby facilitating the opening and closing of the door.

An object of the present invention is to decrease the effort required to open the hopper doors of a railway hopper car loaded with bulk material.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
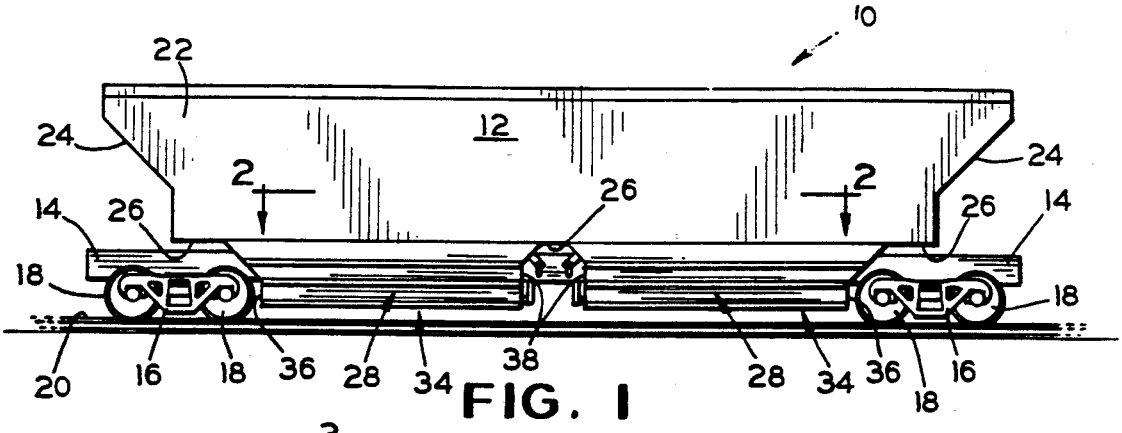
FIG. 1 is an elevation view of a railway hopper car in accordance with the present invention.
Figure 2:
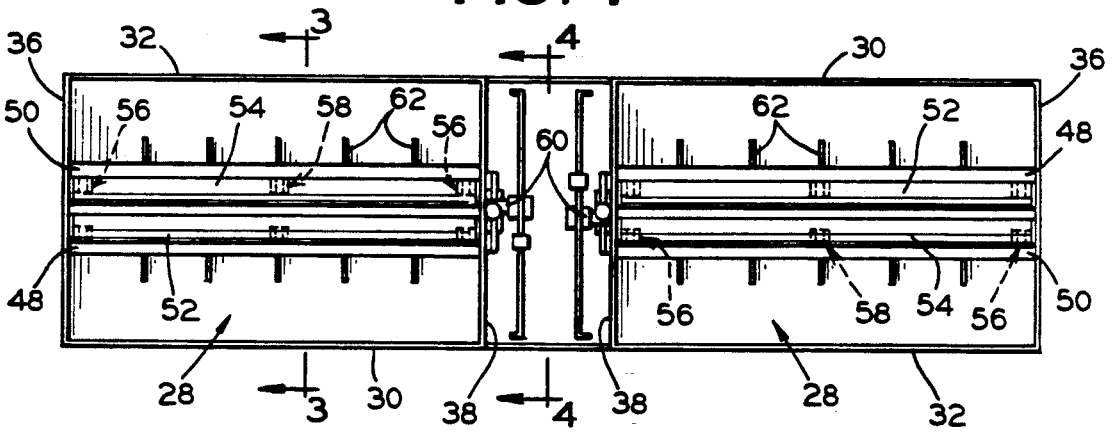
FIG. 2 is top plan schematic view of the hoppers of the railway car shown in FIG. 1 as if taken in cross section along the line 2—2 and enlarged with the doors open.
Figure 3:
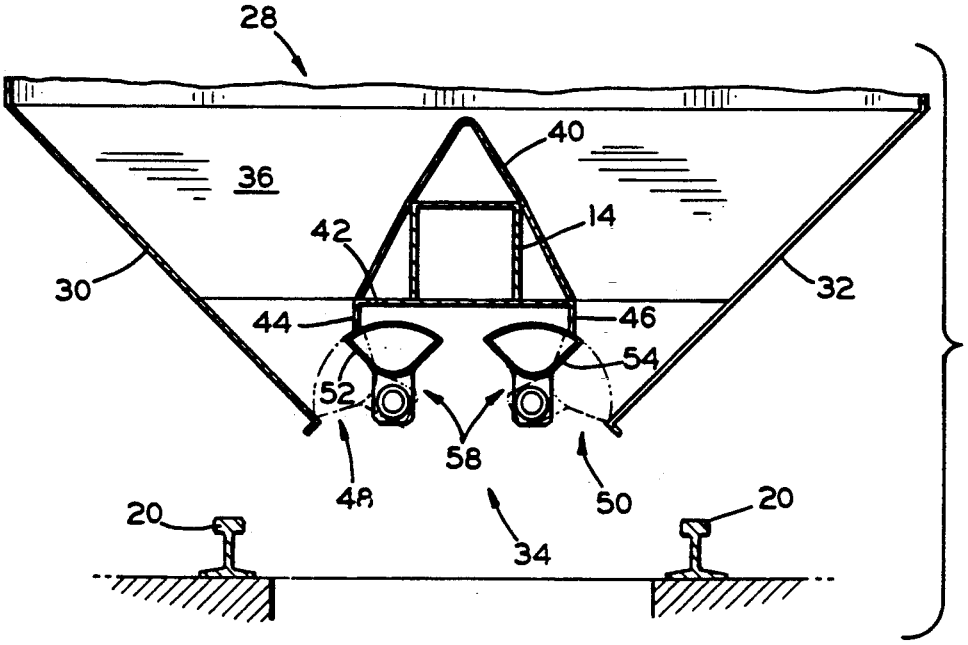
FIG. 3 is a cross-sectional view of one of the hoppers shown in FIG. 2 as if taken along the line 3—3 and enlarged.

Referring to FIGS. 1 through 3, there is illustrated a hopper-type railway car, for transporting bulk materials, generally indicated by the reference numeral 10. The car 10 has a body 12 mounted on a frame 14 which frame is supported at opposite ends by a pair of conventional trucks 16 each having four wheels 18 for engaging a pair of rails 20 (only one is shown in FIG. 1) of a railroad track. The body 12 includes a pair of generally parallel and longitudinally extending sidewalls 22 (only one is shown) each of which extends vertically upwardly and flares outwardly in an upper portion thereof. Adjacent ends of the sidewalls 22 are joined by a pair of generally vertically downwardly and inwardly extending end walls 24. At a central portion of the car body 12, a generally vertical central wall 25 is attached to the sidewalls 22 to divide the car body in half and terminates at a lower edge in a pair of interior walls 26 which are attached to and extend between the sidewalls 22 in an inverted "V-shape" to form two openings in the car bottom for a pair of hoppers as described below.

The two openings in the car bottom each communicate with an associated one of a pair of hoppers 28 attached to the bottom of the car 12. The hoppers 28 are carried on the frame 14 to support the body 12 and are shown schematically in FIG. 2. The hoppers 28 are identical in construction, the configuration of which is illustrated in FIGS. 2 and 3, and are oriented in opposite directions. Each of the hoppers 28 is formed of a pair of generally longitudinally extending sidewalls 30 and 32 extending downwardly and inwardly from the sidewalls 22 to form a longitudinally extending elongated discharge opening 34. Edges of the sidewalls 30 and 32 adjacent the trucks 16 are joined by a generally vertical outer end wall 36 which is attached to and extends vertically downwardly from a lower edge of the end wall 24. Edges of the sidewalls 30 and 32 adjacent the center of the body 12 are joined by a generally vertically extending inner end wall 38. An upper edge of the inner end wall 38 is attached to a lower edge of the adjacent interior wall 26.

The frame 14 is formed as a box beam which extends through the end walls 36 and 38. The frame 14 is aligned longitudinally with and above the openings 34. Inside each of the hoppers 28, the frame is enclosed by a shield 40 having an inverted V-shape. The shield 40 has a pair of legs which extend downwardly and outwardly from an apex and contact upper edges of the frame beam 14. The legs continue downwardly and outwardly terminating in edges which abut and are attached to opposite ends of generally horizontally extending plates 42. The plates 42 are positioned at opposite ends and the center of each of the hoppers 28 above hinges which are described below. The longitudinal edges of the plates 42 are attached to a pair of longitudinally extending L-shaped flanges 44 and 46 positioned to cooperate with the sidewalls 30 and 32 respectively and divide the discharge opening 34 into a pair of generally parallel, longitudinally extending outlet ports 48 and 50 respectively. The shield 40, the plates 42 and the frame 14 are not shown in FIG. 2 in order to reveal the doors which are described below.

The outlet ports 48 and 50 can be selectively opened and closed by an associated pair of doors 52 and 54 respectively. The doors 52 and 54 are composed of a suitable material such as steel. The doors 52 and 54 are hollow and have an inverted bell shape in cross section as best seen in FIG. 3. Each of the doors is rotatably mounted on the hopper by three hinges, a pair of end hinges 56 and a center hinge 58. The doors 52 and 54 associated with each of the hoppers 28 can be selectively rotated between closed and open positions by a door actuator assembly 60 for loading bulk material into the car 10 and discharging the material respectively as will be discussed below. Internal to each of the hoppers 28 are a plurality of spaced-apart ribs 62 which are attached to the sidewalls 30 and 32. The ribs 62 extend upwardly from each of the outlets 48 and 50 to add support to stiffen the sidewalls 30 and 32.

Figure 4:
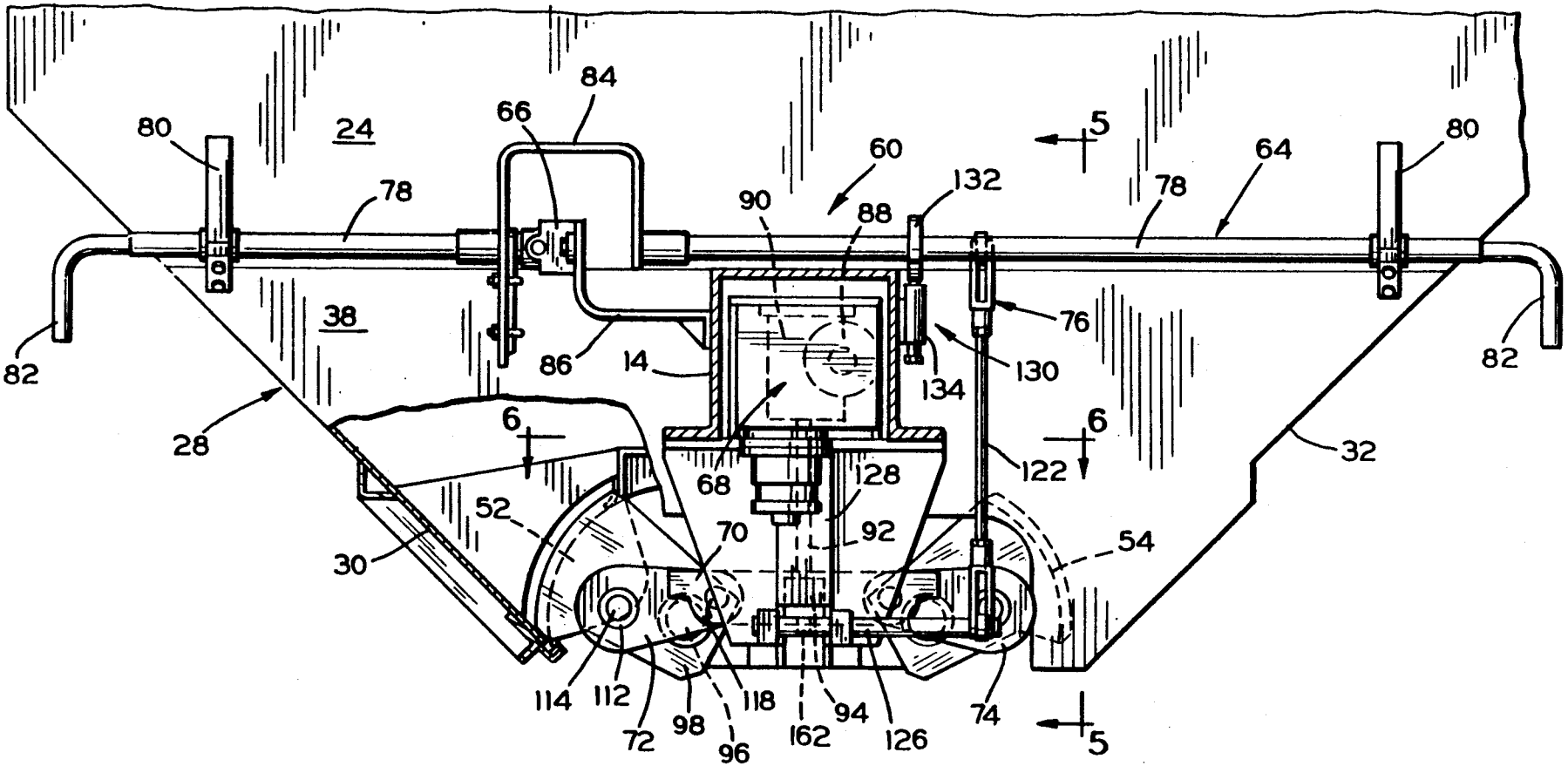
FIG. 4 is a cross-sectional view of one of the hoppers shown in FIG. 2 as if taken along the line 4—4 and enlarged with the doors closed.
Figure 5:
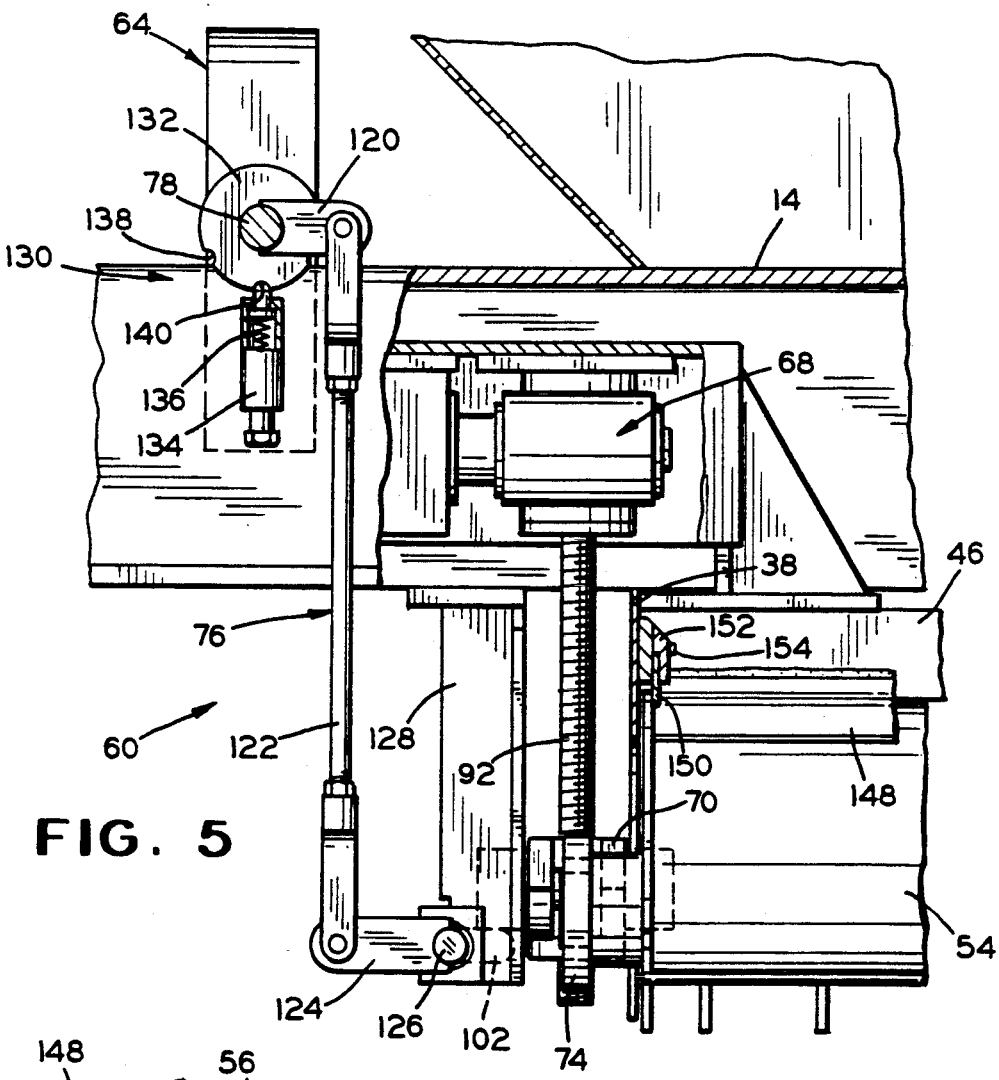
FIG. 5 is an enlarged fragmentary cross-sectional view of the hopper shown in FIG. 4 taken along the line 5—5.
Figure 6:
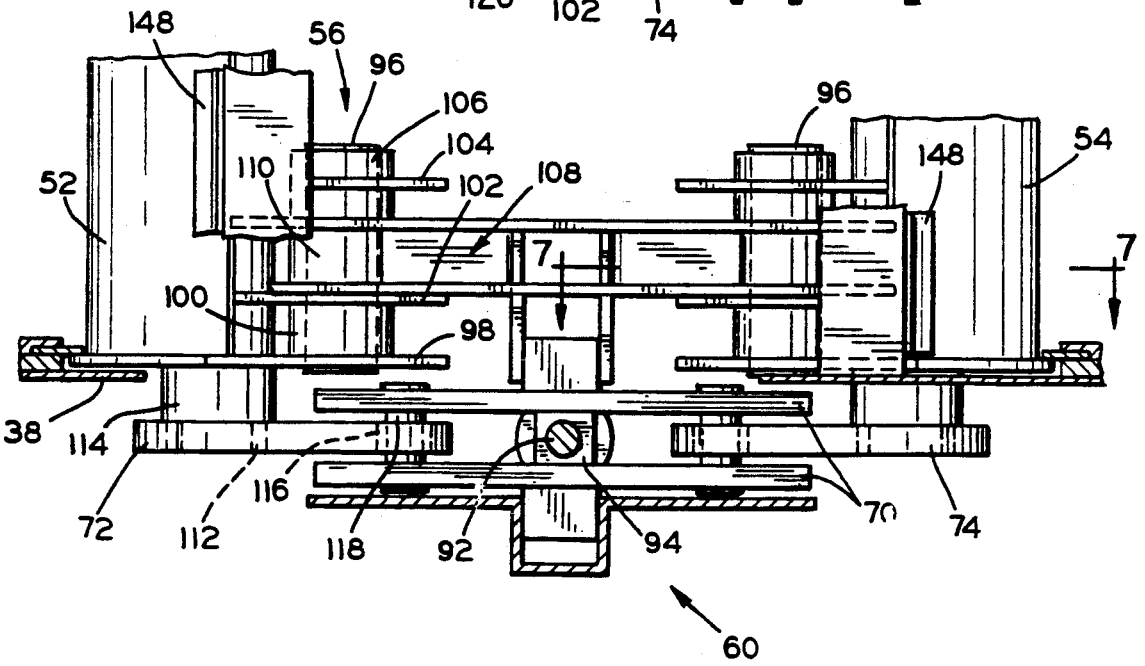
FIG. 6 is an enlarged fragmentary cross-sectional view of the hopper shown in FIG. 4 taken along the line 6—6.

The door actuator assembly 60, as illustrated in FIGS. 4 through 6, includes a handle assembly 64 connected to actuate a control valve 66 for turning on and off a conventional pneumatic motor driven screw jack 68. The screw jack is connected to move a cross beam 70 in a vertical direction and the beam 70 is coupled to a pair of link arms 72 and 74 which in turn are coupled to the doors 52 and 54 respectively. A shut-off mechanism 76 is coupled between the handle assembly 64 and the bottom of the screw jack 68 to automatically shut off the pneumatic motor when doors 52 and 54 are closed.

The handle assembly 64 includes horizontally disposed actuating rod 78 rotatably attached to the end wall 24 by a pair of brackets 80. The ends of the rod 78 are formed at right angles to its longitudinal axis to function as handles 82 for rotating the rod. The rod 78 is split and adjacent ends are interconnected by an inverted J-shaped bracket 84. A longer leg of the bracket 84 is attached to the actuator of the control valve 66 while the body of the valve is attached to a bracket 86 mounted on the frame 14.

The frame 14 provides support for and encloses a pneumatic motor 88 and a gear box 90 of the screw jack 68. The motor drives a vertically disposed screw 92 through the gear box and the screw is coupled to a nut 94 which is attached to the cross beam 70. As the cross beam 70 is moved along the screw 92 the doors 52 and 54 are opened and closed as discussed below.

The door 52 is rotatably mounted adjacent the door actuator assembly 60 at a first pivot point by one of the end hinges 56. Each of the end hinges 56 includes a pin 96 having a longitudinal axis defining the first pivot point. The door 52 has an end attached to one end of a first hinge bracket 98. The bracket 98 has an aperture formed in an opposite end thereof for receiving an end of the pin 96. A sleeve bearing 100 is attached to the hinge bracket 98 and positioned concentrically with the aperture such that the bracket 98 and the door 52 rotate about the first pivot point. A second hinge bracket 102 has one end attached to the door 52 and an opposite end attached to the sleeve bearing 100 such that the brackets 98 and 102 are spaced apart by the sleeve bearing 100. A third hinge bracket 104 has one end attached to the door 52 and a sleeve bearing 106 extends through and is attached to an opposite end of the bracket 104. The sleeve 106 is spaced from the bracket 102 by a frame mounting bracket 108 having a sleeve bearing 110. The bracket 108 is attached to the frame 14 such that the bracket 108 and the sleeve bearing 110 form one half of the hinge 56 and the brackets 98, 102 and 104 and the sleeve bearings 100 and 106 form the other half, the two halves being coupled by the pin 96.

The link arm 72 has an aperture formed at an outer end thereof for retaining a bushing 112. The bushing 112 receives a reduced diameter end of a shaft 114 which has a larger diameter end attached to the bracket 98. The longitudinal axis of the shaft 114 defines a second pivot point about which the door 52 and the link arm 72 rotate. An inner end of the link arm 72 has an aperture formed therein for retaining a bushing 116 A pin 118 is rotatably mounted in the cross beam 70 and extends through the bushing 116. The longitudinal axis of the pin 118 defines a third pivot point about which the link arm 72 can rotate.

Figure 9:
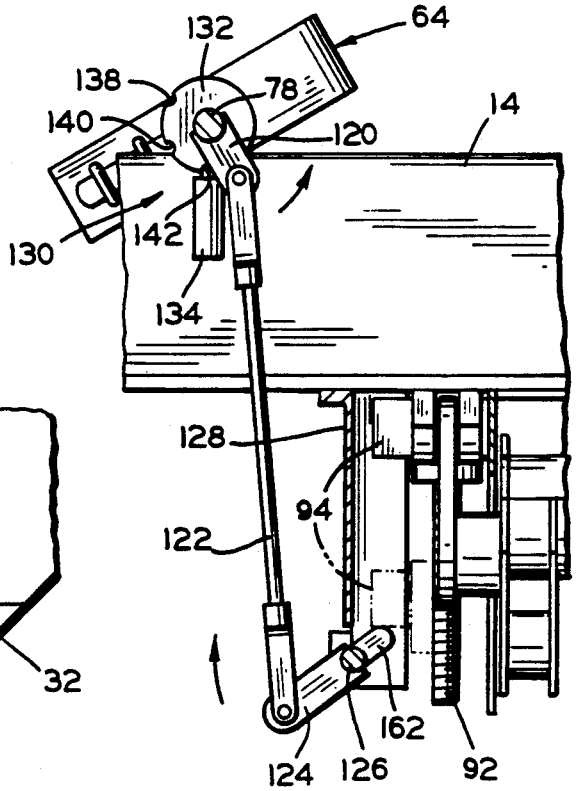
FIG. 9 is an enlarged fragmentary cross-sectional view of the door operating apparatus, similar to FIG. 5, showing the door open position.

The shut-off mechanism 76 extends downwardly from the rod 78 to the base of the screw 92 as illustrated in FIGS. 4, 5 and 9. The shut-off mechanism 76 includes a first arm 120 having one end attached to the rod 78 and extending radially outwardly therefrom. The opposite end of the arm 120 is pivotally connected to an upper end of a generally vertically extending connecting link 122 having a lower end pivotally connected to one end of a second arm 124. An opposite end of the second arm 124 is attached to a shaft 126 rotatably mounted on a bracket 128 attached to and extending downwardly from the frame 14.

The shut-off mechanism 76 also includes a multi-position locking mechanism 130 for maintaining a position of the handle assembly 64 determined by either the shut-off mechanism 76 or by manual rotation of the handles 82. The locking mechanism 130 is located on the cross beam 70 between the frame 14 and the shut-off mechanism 76. The locking mechanism 130 includes a cam 132 mounted concentrically on the rod 78. The cam 132 has three notches formed approximately sixty degrees apart in its periphery for receiving a vertically slidable stop member 134 biased to an engaged position by a spring 136. When the member 134 engages one of the notches, the rod 78 is prevented from rotating. The three notches 138, 140 and 142 of the cam 132 represent the opening, stop, and closing modes of operation of the doors, respectively.

Figure 7:
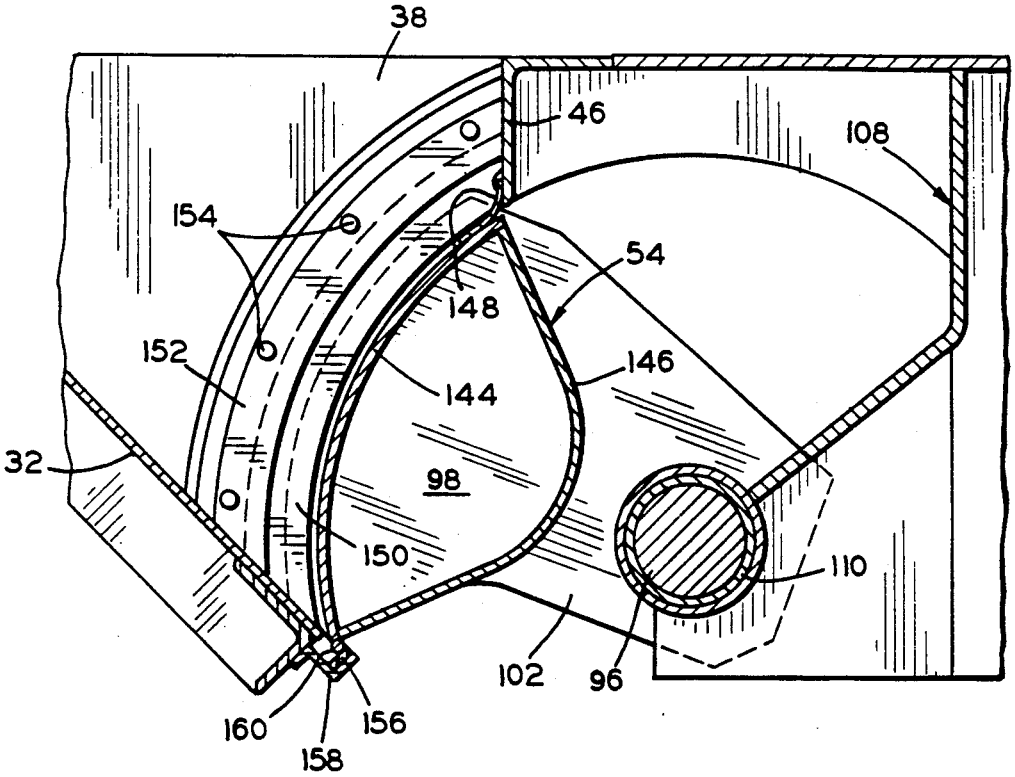
FIG. 7 is an enlarged fragmentary cross-sectional view of the door of the hopper shown in FIG. 6 taken along the line 7—7.

As shown in FIGS. 4, 5 and 7, the doors 52 and 54 are formed as hollow structures. The doors 52 and 54 have an arcuate wall 144 with an outer surface facing into the hopper and a generally U-shaped wall 146, the longitudinal edges of the walls being connected. The walls 144 and 146 are formed from a relatively thin material for flexibility. The doors 52 and 54 have ends closed by the brackets 98 and have a longitudinal axis extending from one bracket 98 to another. Seals are provided around the openings 48 and 50 for sealing at the peripheries of the doors 52 and 54 in the closed position.

Torque is applied to one of the brackets 98 for rotating the door structure about the pin 96. Assuming that the other end of the door structure is constrained against movement, the application of torque to the one bracket 98 tends to twist the door structure, bending the structure about a longitudinal axis thereof. The torque transmitted along the door structure in this manner acts in a direction to force the constrained end of the door back in alignment with the rotated end.

The flexible structure of the doors 52 and 54 is particularly advantageous when certain bulk materials such as grain are stored in the hoppers 28. Such materials contain moisture which can cause ice to form between the doors 52 and 54 and the material and between the doors 52 and 54 and a plurality of seals positioned between the doors 52 and 54 and the hopper. As the torque is transmitted along the longitudinal axis of the door structure, ice, frozen on the surface of the doors 52 and 54 facing the bulk material frozen across the seals, breaks away from the door and the seals. The break-up of ice on the doors facilitates the opening and closing of the doors 52 and 54.

As illustrated in FIGS. 5 through 7, a lip seal 148 extends the length of each of the flanges 44 and 46 and has one edge attached thereto. The lip seal 148 has an opposite edge which slidingly and sealingly engages the outer surface of the doors 52 and 54. An end seal 150 is contoured to the arcuate shape of the wall 144 and is attached to the inner end wall 38 by a mounting bracket 152 and suitable fasteners 154. A similar end seal (not shown) is provided on the outer end wall 36. The seals 150 sealingly overlap the brackets 98. A pressure seal 156 is positioned in a seal retainer 158 attached to a lower edge of the side wall 32 as shown in FIG. 7. A sealing flange 160 is provided on the abutting edge of the door 54 which flange 160 sealingly cooperates with the seal 156 in a closed position of the door 54. As stated above, the door 52 is provided with similar seals.

The seals function to prevent discharge of the bulk material from the hoppers 28 when the doors 52 and 54 are closed. The bulk material applies a force on the closed doors 52 and 54 and the seals 148 and 150 thereby providing a positive seal about the periphery of the doors. When bulk materials containing moisture are stored in the hoppers 28, ice is formed along the edges of the seals 148 and 150. When torque is applied to one of the brackets 98, the torque is transmitted along the longitudinal axis of the door structure, thereby breaking up ice, frozen on the surface of the seals 148 and 150.

To actuate the door operating apparatus according to the present invention, an operator turns either of the handles 82 to rotate the rod 78 in the desired direction. The direction of rotation will determine whether the doors will open, stop or close. For example, if the doors are in the closed position as illustrated in FIGS. 4 and 5, the notch 140 is engaged by the stop member 134, the arms 120 and 124 are in a generally horizontal position and the nut 94 abuts an end-of-travel extension 162 attached to the shaft 126. If the rod 78 is rotated in a counter-clockwise direction viewed as in FIG. 5, the cam 132 will be rotated to engage the notch 138 with the stop member 134. The rotation of the rod 78 also actuates the valve 66 which connects the motor 88 to a source of pneumatic power to rotate the screw 92 and raise the cross beam 70. When the cross beam 70 reaches the top of the screw 92, as shown in the FIG. 8, further upward movement is blocked by the frame 14. The valve can then be shut-off by any suitable means. The rod 78 can remain in the open position just described or can be returned to the stop position shown in FIG. 5.

Figure 8:
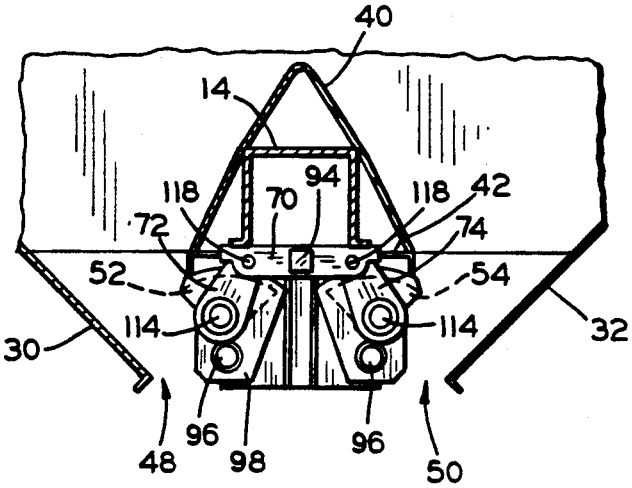
FIG. 8 is a schematic elevational view of the hopper according to the present invention showing the doors in an opened position.

As the cross beam 70 moves upwardly, the link arms 72 and 74 rotate about the third pivot points toward a more vertical position as shown in FIG. 8. The movement of the link arms causes rotation about the second pivot points and the first pivot points to open the doors 52 and 54 thereby allowing discharge of material from the hopper through the outlet ports 48 and 50 respectively. The curved surfaces of the doors 52 and 54 are nearly vertical in the closed position and slide along the material in the hopper with little resistance to facilitate the opening of the doors.

To close the doors 52 and 54, the rod 78 is rotated to engage the notch 142 with the stop member 134 as illustrated in FIG. 9. The control valve 66 is actuated to reverse the motor 88 and move the cross beam 70 downwardly to the position shown in FIG. 4. As the nut 94 moves down the screw 92, the nut engages the extension 162 of the shut-off mechanism 76 in the position shown in phantom in FIG. 9. The nut 94 forces the extension 162 downward until the extension is generally horizontally disposed. The downward movement of the extension 162 effectuates an upward movement of the link 122 causing the rod 78 to rotate the cam 132 to the stop position where the notch 140 engages the stop member 134 and the motor 88 is turned off. The doors 52 and 54 are now closed again. The handles 82 also can be used to manually actuate the control valve 66 and position and stop the doors in any partially open position.

The thinness of the material used to make the walls of the doors provides flexibility. The flexibility of the doors facilitates the transmission of torque, applied at one end of the door, along the body of the door. The transmission is particularly advantageous in breaking up ice which can form on the door. The break up of ice facilitates the opening and closing of the door.

The shape and positioning of the doors provides outlet ports extending the entire length of the hopper compartment. Thus, a single hopper in accordance with the present invention can replace several smaller prior art hoppers thereby increasing the capacity of the hopper for storing a greater quantity of cargo material. The larger capacity hopper also lowers the center of gravity of the loaded car thereby making the car more stable. Furthermore, the larger single discharge outlet versus the smaller prior art outlets facilitates an increase in the discharge rate of the car.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A door apparatus for use in discharging bulk material from a hopper on a railway car comprising:

an elongated flexible hollow body for closing an elongated material discharge opening formed in a hopper;

a pair of end walls, one of said end walls is constrained from movement, attached to opposite ends of and enclosing an interior of said body, each said end wall having a first pivot point for rotary attachment to the hopper, and said body being rotatable about the first pivot points between an open position and a closed position; and means for attaching at least one of said end walls attached to one end of said body to a means for rotating said body about the first pivot points between the open position and the closed position, whereby when said body is rotated about said first pivot point at said one end and an opposite end of said body is prevented from rotating, said body is twisted about a longitudinal axis to transmit torque from said one end to said opposite end.

2. The apparatus according to claim 1 wherein the hopper extends in a longitudinal direction beneath a railway car and said body and the discharge opening extend in a longitudinal direction a length of the hopper.

3. The apparatus according to claim 1 wherein said body has an arcuate surface formed thereon extending across a width of the discharge opening for closing the discharge opening in the closed position of said body.

4. The apparatus according to claim 1 wherein said body has an inverted bell shaped cross-section.

5. The apparatus according to claim 1 wherein said door is a first door for closing a first outlet port in the discharge opening, and including a second door having an elongated flexible hollow body for closing an associated second outlet port in the discharge opening, said second door having a pair of end walls attached to opposite ends of and enclosing an interior of said body of said second door, each said second door end wall having a first pivot point for rotary attachment to the hopper, and said second door body being rotatable about associated first pivot points between an open position and a closed position; and means for attaching at least one of said second door end walls attached to one end of said second body to said means for rotating for rotating said second door body about said associated first pivot points between the open position and the closed position, whereby when said second door body is rotated about said associated first pivot point at said one end wall and an opposite end of said second door body is prevented from rotating, said second door body is twisted about a longitudinal axis to transmit torque from said one end to said opposite end of said second door body.

6. The apparatus according to claim 1 wherein said body includes at least two walls longitudinally extending from one end wall to another, each said longitudinally extending wall, at opposite edges, attached to another of said longitudinally extending walls and enclosing an interior of said body, said longitudinally extending walls formed of a relatively thin material making said body flexible.

7. The apparatus according to claim 1 wherein said door is made from steel.

8. A railway hopper car for transporting and discharging bulk materials comprising:

a car body for holding bulk material and having a pair of side walls attached to a pair of end walls and an open bottom;

at least one hopper attached to and open to said bottom of said car body, said hopper having an elongated bottom discharge opening for discharging the bulk material from said car body;

an elongated flexible hollow door body for closing the elongated material discharge opening formed in said hopper;

a pair of end walls, one of said end walls is constrained from movement, attached to opposite ends of said door body, each said end wall having a first pivot point for rotary attachment to the hopper and said door body being rotatable about the first pivot points between an open position and a closed position; and means for attaching at least one of said end walls to a means for rotating said door body about the first pivot points between the open position and the closed position, whereby when said one end wall, attached to said means for rotating, receives an applied torque for rotating said door body about the first pivot point at said one end wall, and the other one of said end walls is prevented from rotating, the flexibility of said door body facilitates the transmission of torque applied at said one end wall, along said door body to the other of said end walls.

9. The railway hopper car according to claim 8 wherein said door has a curved surface facing the discharge opening, said curved surface being in a generally vertical plane when said door is in the closed position.

10. The railway hopper car according to claim 8 wherein said hopper extends a substantial distance in a longitudinal direction beneath said car body, and said door and the discharge opening extend in a longitudinal direction a length of said hopper, said hopper forming an enclosure for bulk material whereby a center of gravity of the car is lowered.

11. A door apparatus for railway hopper car for discharging bulk materials from the car comprising:

a pair of doors for closing outlet ports in a discharge opening in the bottom of a hopper, each said door including an elongated hollow body having an arcuate surface formed thereon extending across a width of the discharge opening for closing the discharge opening in the closed position of the body, a pair of end walls, one of said end walls is constrained from movement, attached to opposite ends of said body, each said end wall having a first pivot point for rotary attachment to the hopper and said body being rotatable about the first pivot points between an open position and a closed position, and means for attaching at least one of said end walls to a means for rotating said body about the first pivot points between the open position and the closed position; and means for rotating said body of each of said doors about the first pivot points between the open position and the closed position.

* * * * *